United States Patent [19]

Beck

[11] Patent Number: 4,699,056

[45] Date of Patent: Oct. 13, 1987

[54] INKING MECHANISM HAVING A TRANSFER ROLLER WITH ADJUSTABLE SPEED

[76] Inventor: Erich Beck, Am See 29, 6520 Worms 27, Fed. Rep. of Germany

[21] Appl. No.: 833,123

[22] Filed: Feb. 26, 1986

Related U.S. Application Data

[63] Continuation-in-part of Ser. No. 564,821, Dec. 23, 1983, abandoned.

[30] Foreign Application Priority Data

Dec. 24, 1982 [DE] Fed. Rep. of Germany ..... 3248032
Feb. 5, 1983 [DE] Fed. Rep. of Germany ..... 3303884

[51] Int. Cl.[4] ..... B41F 31/04; B41F 31/08
[52] U.S. Cl. ..... 101/366; 101/157
[58] Field of Search ..... 101/365, 366, 363, 364, 101/207, 208–210, 157, 169

[56] References Cited

U.S. PATENT DOCUMENTS

| | | | |
|---|---|---|---|
| 1,788,504 | 1/1931 | Ball | 101/366 X |
| 1,962,011 | 6/1934 | Ginsberg | 101/366 X |
| 2,018,193 | 10/1935 | Smith | 101/366 |
| 2,081,906 | 6/1937 | Ball | 101/366 |
| 2,177,656 | 10/1939 | Haddeland | 101/366 |
| 2,573,336 | 10/1951 | Holmwood | 101/157 X |
| 2,931,297 | 4/1960 | Coudriet | 101/157 |
| 3,044,396 | 7/1962 | Allen | 101/157 |
| 3,198,113 | 8/1965 | Feller | 101/208 |
| 3,319,563 | 5/1967 | Champion et al. | 101/207 |
| 3,739,717 | 6/1973 | Brown et al. | 101/366 X |
| 4,064,801 | 12/1977 | Switall | 101/366 |
| 4,281,597 | 8/1981 | Dressler | 101/366 X |

FOREIGN PATENT DOCUMENTS

| | | | |
|---|---|---|---|
| 1133737 | 7/1962 | Fed. Rep. of Germany | 101/366 |
| 293919 | 7/1928 | United Kingdom | 101/366 |

*Primary Examiner*—J. Reed Fisher
*Attorney, Agent, or Firm*—Fleit, Jacobson, Cohn & Price

[57] ABSTRACT

An apparatus for applying printing ink onto a form roller of a printing machine which includes an enclosed ink fountain mounted adjacent the form roller. The ink fountain has a housing with a chamber formed thereon. A friction roller is rotatably and eccentrically movably mounted within the chamber of the ink fountain housing, wherein the eccentricity distance of the friction roller in relationship to the ink fountain housing and the rotation of direction and speed of the friction roller are independently adjustable. The eccentricity distance of the friction roller relative to the ink fountain housing is adjustable from a concentric position of the friction roller in the chamber of the ink fountain housing to a contact position of the friction roller with the ink fountain housing. The apparatus further includes a pair of doctor blades positioned longitudinally along the form roller for defining an ink space between the ink fountain housing and the form roller. A pressure sealing assembly is positioned between the pair of doctor blades at opposite ends thereof for forming a closed ink distribution space between the ink fountain and the form roller. An ink discharge outlet is formed in the ink fountain housing for supplying ink from the enclosed chamber of the ink fountain to the enclosed ink space adjacent the form roller, with the contact position of the friction roller with the ink fountain housing during eccentricity movement of the friction roller being adjacent the ink discharge outlet.

8 Claims, 6 Drawing Figures

INKING MECHANISM HAVING A TRANSFER ROLLER WITH ADJUSTABLE SPEED

This is a continuation-in-part of co-pending application Ser. No. 564,821, filed Dec. 23, 1983, now abandoned.

BACKGROUND OF THE INVENTION

Field of the Invention

The invention relates to an apparatus for applying printing ink onto a form roller, preferably for flexographic and gravure presses, as well as for planographic presses, using an ink fountain. More particularly, the invention is directed to an ink feed system which can transport and distribute even heavy ink from an ink tank via an enclosed ink fountain to the form roller, wherein the degree of viscosity prevailing during the transfer from the enclosed ink fountain onto the form roller can be adjusted by the rotational speed of the transfer roller located in the enclosed ink fountain. Moreover, the pressure as well as the flow rate in the ink fountain can be controlled by adjusting the rotational velocity of a pump used in connection with the ink supply.

Form rollers are conventionally known as the ink rollers which contact and supply ink to the printing form is a letter press machine or to the press plate in a lithographic or a rotary press. It is common practice to distribute printing inks to form rollers, for example, of flexographic and gravure presses, by immersing duct rollers or feed rollers into a color duct and pressing the accepted ink film against the form roller, the overflowing ink returning to the color duct. Form rollers are also known in which, in addition to the reservoir in the color duct, an auxilliary reservoir is employed outside the color duct and in which an ink pump is provided that pumps the printing ink continuously into the color duct, with the ink returning by the force of gravity. Other form rollers are known, as exemplified by U.S. Pat. No. 3,766,856 and published West German Application No. 31 35 711, in which the printing ink is fed to the form roller through a distribution chamber or through a guide conduit. Here, too, however, the overflowing ink returns by gravitational force to a reservoir provided with an ink pump. In these designs, the ink viscosity is known to be changed by the addition of solvents.

Depending upon the printing quality requirements, the solvents are admixed with the printing ink directly in the color duct or in an ink tank which is connected to the color duct via a return hose coupling, whereby a pump in the ink tank maintains a continuous ink flow between the color duct and ink tank. High quality and levelness requirements can be achieved with this type of circulating ink system and with an auxiliary viscosity regulator. However, the energy expended for this type of prior art equipment for the evaporation of the solvents and the attendant environmental pollution, as well as the expensive cleaning of the circulating ink system for the change of inks, prove to be significant drawbacks. This is especially true since a low viscosity for these circulating ink systems is not necessary for obtaining good printing qualities.

It is also known in the prior art to provide form rollers for planographic presses in which inks with a high viscosity are friction-glazed and, by means of a set of distributor rollers, distributed evenly across the form roller. A stationary grinding effect, however, can only be obtained by a tandem connection of a plurality of rollers.

A principal object of the invention is to provide an apparatus for applying printing ink onto a form roller that can evenly transfer heavy inks without dilution onto the form roller, e.g., an engraved roller.

It is a further object to provide such an apparatus in which the ink viscosity can be adjusted just before the ink transfer onto the form roller by friction in an enclosed ink chamber or fountain using a thin friction clearance between the convex surface of a transfer or friction roller and a concave cylindrical surface of the fountain housing.

Yet a further object is to provide the ink-loading spaces in the ink supply system so that, when exchanging inks, washing with a relatively small amount of solvent will lead to thorough cleaning.

These and other objects are achieved by the teachings of the invention, wherein an apparatus for applying printing ink onto a form roller of a printing machine comprises an enclosed ink fountain mounted adjacent the form roller and having a housing with a chamber formed therein; and a friction roller rotatably and eccentrically moveable within the chamber of the ink fountain housing, wherein the eccentricity distance of the friction roller in relationship to the ink fountain housing and the rotational direction and speed of the friction roller are independently adjustable.

An ink pump is used with a preferably air-tight ink tank. This ink pump conveys the printing ink under pressure from the pump outlet, via a friction chamber or an enclosed ink fountain and an enclosed ink distribution chamber, to the form roller. A centrifugal pump can likewise be used as a gear pump or a hose pump for supply of the ink. In all cases, pump pressure and flow rate can be controlled by adjusting the pump's rotational speed.

The ink is conveyed to an ink fountain through an inlet opening connected to a pump supply pipe. Since the ink flow rate is solely determined by the ink consumption, the pipe cross section can have a diameter of only a few millimeters.

In the ink fountain, which is preferably cylindrical but which may also have an oval or a polygonal cross section, there is povided a transfer or friction roller which is movably mounted and pivoted about its longitudinal axis and whose radial distance to the inner chamber wall of the ink fountain can be adjusted.

Opposite the ink supply inlet or at an angle thereto, there is an ink outlet opening which leads to a narrow ink distribution chamber into which is fed the ink that has been adjusted by friction in the ink fountain to a specific viscosity. This ink distribution chamber is sealed on all sides and is defined by two doctor blades in the direction of rotation of the form roller.

The adjustment of the viscosity of the printing ink by the transfer roller presupposes a controllable speed of rotation of the transer roller and adjustable radial distance of the transfer roller to the inner chamber wall of the ink fountain independent of the circumferential velocity of the form roller due to the effect of the two "influencing variables"—shearing force and temperature. The shearing force can be determined within a broad range by changing the circumferential speed of the transfer roller and by varying the friction clearance (i.e., the distance "d" between the transfer roller and the inner chamber wall of the ink fountain on the ink outlet side).

Due to the thermoplastic conditions prevailing in almost all flexographic and gravure printing inks, the resultant temperature as a function of the shearing force also affects the viscosity.

The present test results with heavy links show that in order to obtain good printing qualities, it is not necessary to lower the ink viscosity to a conventional value of about 25 seconds in a Ford cup having an efflux with a diameter of 4 mm.

In one test, a water-soluble ink was used with an efflux time of 56 seconds from a 6-mm Ford cup. If the 50-mm transfer roller had a rotational speed of 350 rpm, this ink could be pressed in the doctor blade chamber with the proper quality.

The thixotrope conditions of the ink was evidenced by a treatment in an agitator. After stirring 30 seconds, the viscosity dropped from 56 seconds to 21 seconds efflux time.

However, the requirement for a substantially aqueous liquid is ascribable to the construction of the conventional form rollers in which the ink circulation is maintained by the force of gravity of the ink. A free return of the ink used in the above example is not possible because it leads to a back-pressure, as demonstrated by tests with a conventional form roller. A throwing out of ink lumps from the color duct was observed.

The pressure prevailing in the ink fountain can be adjusted by varying the rotational speed of the pump with coincidental control of the thickness of the ink layer on the form roller.

Since there is no external ink circulation, the amount of ink fed can only flow off via the form roller. Thus, the amount of ink per pressure report can be fixed.

With the apparatus for applying print ink onto a form roller of the present invention and with a forced supply of the ink under adjustable pressure, heavy inks can be used and thereby, a greatly reduced percentage of solvent. This leads to advantages because of the reduction of the energy for drying and reducing the solvent vapor emission.

Other advantages of the apparatus of the invention are seen in the fact that the reaction time from the display of a change of tone value in the print image to the change of color viscosity can be reduced to a few seconds. This permits a tone value correction at the rpm of the transfer roller as a correction variable. The rotational speed of the ink pump and, thereby, of the filling pressure can also be utilized as a correcting variable.

This type of apparatus also admits of a reduction of the entire ink-loading spaces to a lower value of up to one to two powers of 10 in comparison to ink circulating systems of the prior art, and thereby enables cleaning by rinsing without the necessity of dismounting the color duct that would otherwise be necessary.

Since the ink circulation occurs within the ink fountain, only a relatively small volume of ink is in the ink circulating spaces. Also with the apparatus of the invention, in order to prevent the ink from drying during relatively long idle periods, solvents can be fed. Solvent delivery can be effected directly into the ink fountain in a manner known from the prior art, controlled by the driving movement of the transfer roller, or it can be effected by spraying an appropriate solvent directly onto the form roller. Another possibility of adding solvent in the case of relatively long idle periods consists of using one of the ink supply ducts or the return ducts from which the ink is supplied and returned to the ink tank. In this case, the ink tank volume again is determined only by the effective consumption of quantities per job.

BRIEF DESCRIPTION OF THE DRAWINGS

The nature of the invention will now be described in conjunction with the accompanying FIGS. 1 to 5 which depict preferred embodiments. In the drawings.

DETAILED DESCRIPTION OF THE PREFERRED EMBODIMENTS

Figure 1:
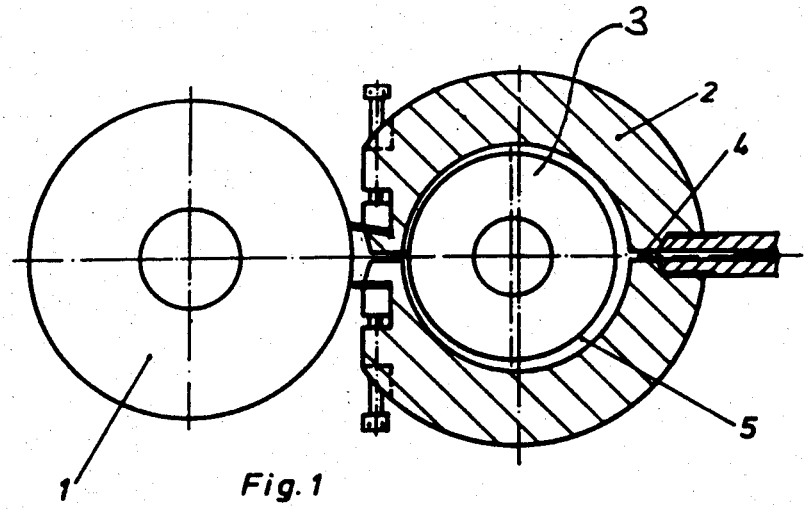
FIG. 1 is a schematic cross section of the apparatus of the invention.
Figure 2:
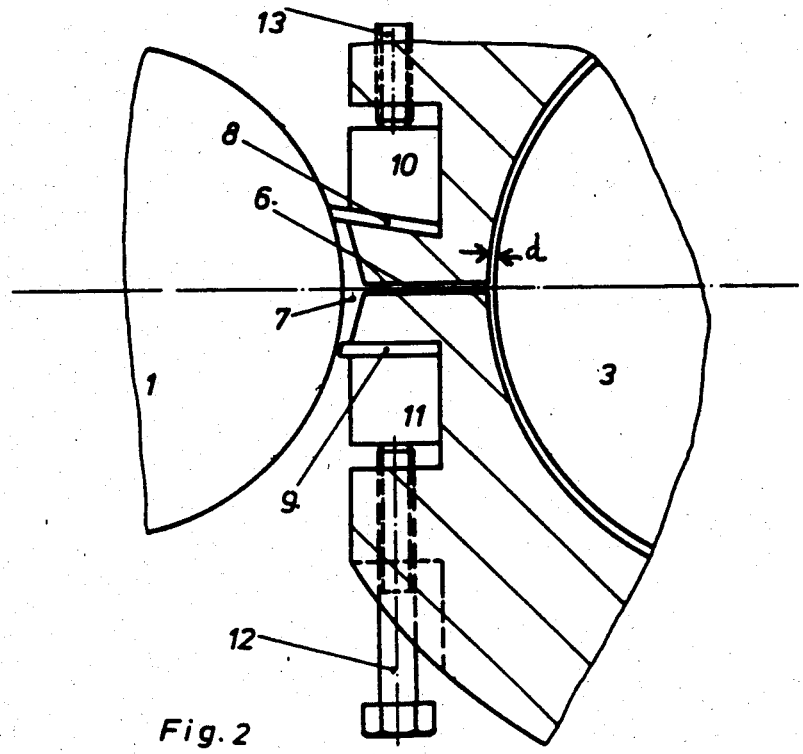
FIG. 2 is a schematic exploded partial cross-section of the area of the apparatus which is in contact with the form roller as shown in FIG. 1.

An apparatus as described with reference to FIG. 1 and in accordance with the invention comprises a form roller 1 with a housing 2 and an ink fountain 5 within housing 2 forming an inner chamber therein, preferably in a cross section and in which is located a transfer or friction roller 3 movably mounted and pivotable about its longitudinal axis shaft at the roller ends to rotate in either direction of rotation. Preferably, the means for movably or rotatably mounting the roller 3 comprises bearing mechanisms 20 radially displaced at the ends of the shaft 22 of roller 3. The drive of the transfer roller preferably comprises a separate D.C. motor 24 which can be infinitely controllable and thus can provide a variable speed of rotation to the transfer roller 3. This motor can adjust the surface velocity of roller 3 independently of the velocity of the form roller 1.

The printing ink is pumped into the chamber of ink fountain 5 via an ink inlet supply duct 4 from an ink supply tank (not shown) by means of an ink pump with a variable speed of rotation. The ink supply system is preferaby sealed against the entry of air. A centrifugal pump can be used as a gear pump or hose pump. Supply duct 4 can be formed as a slit nozzle. Duct 4 can also comprise a row of cylindrical bores in ink fountain 5 with corresponding supply lines to the pump for the ink feed.

Figure 5A:
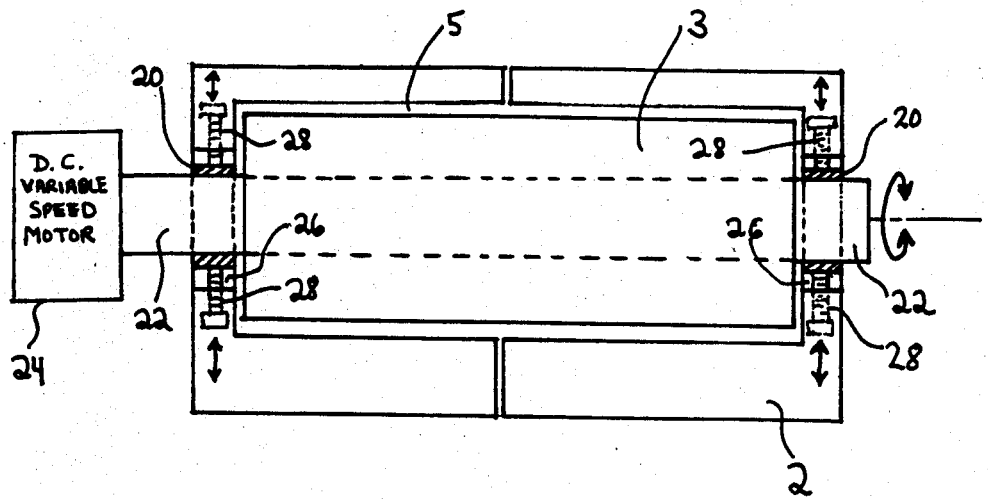
FIGS. 5A and B are schematic partial cross sections of the apparatus shown in FIG. 1, illustrating in particular the means for rotatably mounting the transfer roller and eccentrically moving the transfer roller within the ink fountain.
Figure 5B:
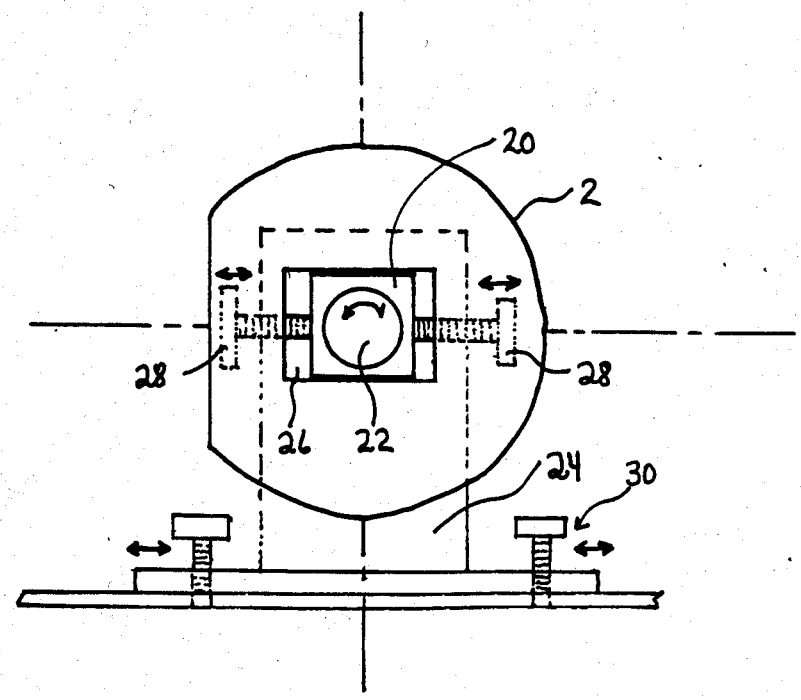

Transfer roller 3 is movably mounted via its rotational shaft 22 using the bearing mechanisms 20 and drive motor 24. Roller 3 further is arranged in ink fountain 5 to provide adjustable eccentricity so that on the ink discharge side of the inner chamber wall of the ink fountain housing adjacent an ink discharge or outlet duct 6, there is a narrower clearance than on the ink inlet feed side. The range of the transfer roller radial adjustment is limited by a center adjustment of the roller relative to the inner walls of the ink fountain housing 2 until roller contact is established with the wall in the inner housing area of ink discharge or outlet duct 6. As best seen in FIGS. 5A and 5B, means for eccentricity adjusting the roller 3 includes slot means 26 in the housing 2 for radially moveably mounting the bearing mechanisms 20, adjusting screws 28 for radially locating the bearing mechanisms 20 in the slot and means 30 for radially adjustably mounting motor 24. The ends of the ink fountain housing and transfer roller shaft are suitably sealed by conventional packing or sealing means around the bearing mechanisms so that there is no ink leakage.

Ink discharge duct 6 and ink delivery space 7 are limited to a size required for the necessary spacing between doctor blades 8 and 9 in order to minimize the reaction time from the transfer roller adjustment from the center towards the ink fountain chamber wall adjacent the ink outlet duct 6 facing the ink-accepting form roller 1. Doctor blades 8 and 9 are secured by clamping strips 10 and 11 and respective adjusting screws 12 and 13.

Outlet duct 6 and ink fountain space 7 are sealed off by means of packing or sealing elements not shown herein in a manner known from the prior art.

Figure 4:
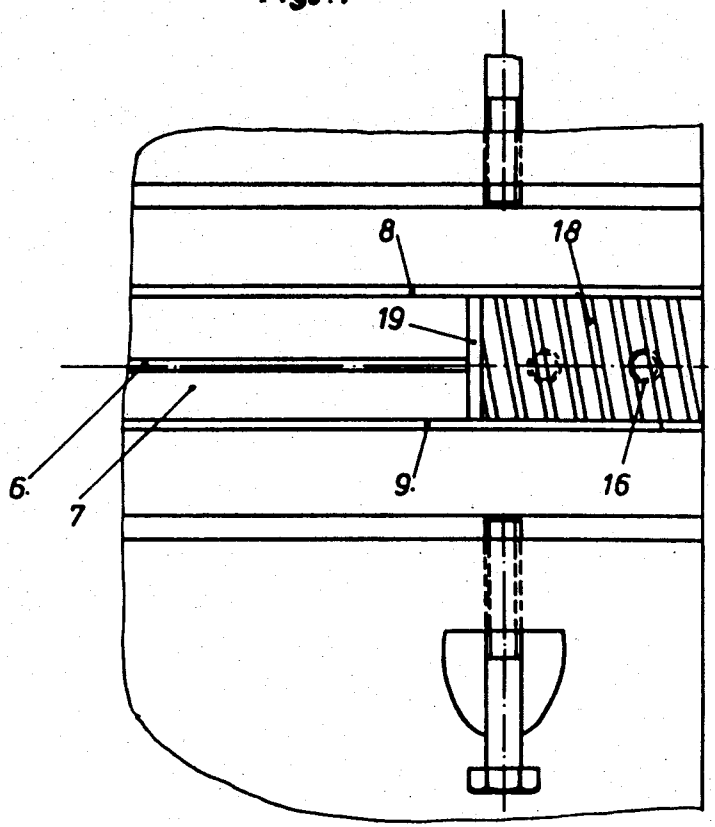
FIG. 4 is a schematic partial cross section of the apparatus shown in FIG. 3, taken along lines 4—4, with the ink fountain defined by the doctor blades and showing the formation of a special jointing surface of the lateral packing.
Figure 3:
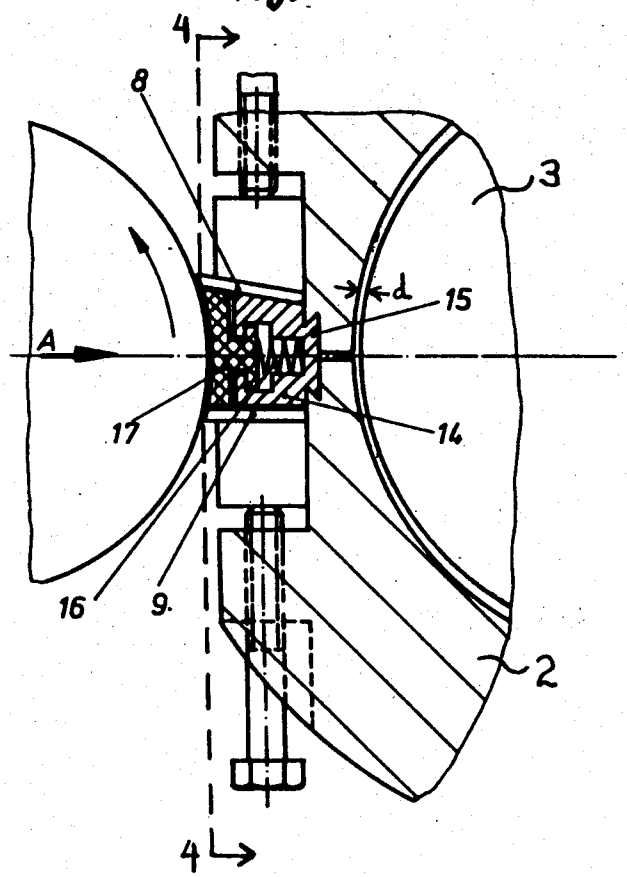
FIG. 3 is a schematic partial cross section of the apparatus of the invention using a special lateral elastic packing.

A special embodiment of an elastic packing assembly for improved sealing, however, is shown in FIGS. 3 and 4. With increasing wear of the doctor blades, 8 and 9, the ink fountain housing 2 changes its position relative to form roller 1. Therefore, it is proposed that the lateral packing be constructed such that the packing strips follow the change of the ink fountain housing position without altering the bearing pressure, whereby a well-defined bearing pressure can be maintained.

As embodied herein, the elastic packing assembly includes a packing strip carrier member 14 inserted into a dovetail groove 15 formed in housing 2 on opposite sides between blades 8 and 9. Packing strip 17 has one end fitted into carrier member 14 and another end pressed in the direction of the engraved or form roller 1 by springs 16 between the strip 17 and member 14.

Flat, inclined grooves 18 are provided in the sliding surface of the packing strip 17. Due to the rotational motion of form roller 1, an advancing effect is exerted on the ink which is being forced outwardly toward ink fountain 7 so as to obtain a better sealing action. Packing plate 19 prevents the ink or cleaning agent from escaping sideways through packing carrier member 14.

To further simplify the ink change, it is proposed that the ink as well as the cleaning agent be placed in a pressure chamber which is so charged with air or gas that the necessary liquid is pumped toward the ink fountain into one or the other liquid tank by inserting a pipe through a packing sleeve. The pump pressure can be adjusted in a manner known from the prior art by means of a pressure reduction valve.

The many features and advantages of the invention are apparent from the detailed specification and, thus, it is intended by the appended claims to cover all such features and advantages of the method which fall within the true spirit and scope of the invention. Further, since as discussed above, numerous modifications and changes will readily occur to those skilled in the art, it is not desired to limit the invention to the exact apparatus as illustrated and described, and, accordingly, all suitable modifications and equivalents may be resorted to, falling within the scope of the invention.

I claim:

1. An apparatus for applying printing ink onto a form roller of a printing maching comprising:

an enclosed ink fountain mounted adjacent the form roller and having a housing with a chamber formed therein;

a friction roller rotatably and eccentrically moveable within the chamber of the ink fountain housing, wherein the eccentricity distance of the friction roller in relationship to the ink fountain housing and the rotational direction and speed of the friction roller are independently adjustable;

a pair of doctor blades positioned longitudinally along the form roller for defining an ink space between the ink fountain housing and the form roller and for limiting ink in the rotational direcitn of the form roller; and means for sealing the opposite lateral ends of the pair of doctor blades, said lateral sealing means including sealing strips positioned between the pair of doctor blades at opposite ends thereof and having a surface facing the form roller in which are formed shallow oblique grooves for affecting an ink feeding toward the ink space in response to rotation of the form roller and the springs for urging the sealing strips into pressure contact with the form roller.

2. The apparatus according to claim 1, wherein the eccentricity distance of the friction roller relative to the ink fountain housing is adjustable from a concentric position of the friction roller in the chamber of the ink fountain housing to a contact position of the friction roller with the ink fountain housing.

3. The apparatus according to claim 2, wherein the supply of ink to and in the enclosed ink fountain is under pressure and wherein the pressure of the ink is independently variable.

4. The apparatus according to claim 1, further comprising an ink discharge outlet formed in the ink fountain housing for supplying ink from the chamber of the ink fountain to the ink spaced adjacent the form roller and wherein the contact position of the friction roller with the ink fountain housing during eccentricity movement of the friction roller is adjacent the ink discharge outlet.

5. The apparatus according to claim 1, wherein the supply of ink to and in the enclosed ink fountain is under pressure and wherein the pressure of the ink is independently variable.

6. An apparatus for applying printing ink onto a form roller of a printing machine comprising:

an enclosed ink fountain mounted adjacent the form roller and having a housing with a chamber formed therein, a friction roller rotatably and eccentrically moveable within the chamber of the ink fountain housing, wherein the eccentricity distance of the friction roller in relationship to the ink fountain housing and the rotational direction and speed of the friction roller are independently adjustable, the eccentricity distance of the friction roller relative to the ink fountain housing being adjustable from a concentric position of the friction roller in the chamber of the ink fountain housing to a contact position of the friction roller with the ink fountain housing, and a pair of doctor blades positioned longitudinally along the form roller for defining an ink space between the ink fountain housing and the form roller and for limiting ink in the rotational direction of the form roller and means for sealing the opposite lateral ends of the pair of doctor blades, said lateral sealing means including sealing strips positioned between said pair of doctor blades at opposite ends thereof and having a surface facing the form roller in which are formed shallow oblique grooves for affecting an ink feeding toward the ink space in response to rotation of the form roller and springs for during the sealing strips into pressure contact with the form roller.

7. The apparatus according to claim 6, further comprising an ink discharge outlet formed in the ink fountain housing for supplying ink for the chamber of the ink fountain to the ink space adjacent the form roller and wherein the contact position of the friction roller with the ink fountain housing during eccentric movement of the friction roller is adjacent the ink discharge outlet.

8. The apparatus according to claim 6, wherein the supply of ink to and in the enclosed ink fountain is under pressure and wherein the pressure of the ink is independently variable.

* * * * *